US005461946A

United States Patent [19]

Nutt

[11] Patent Number: 5,461,946

[45] Date of Patent: Oct. 31, 1995

[54] SETTING TOOL FOR THREADED RODS

[75] Inventor: Hubert Nutt, Mauren, Liechtenstein

[73] Assignee: Hilti Aktiengesellschaft, Fürstentum, Liechtenstein

[21] Appl. No.: 333,383

[22] Filed: Nov. 2, 1994

[30] Foreign Application Priority Data

Nov. 2, 1993 [DE] Germany ..... 43 37 328.3

[51] Int. Cl.[6] ..... B25B 13/50

[52] U.S. Cl. ..... 81/53.2

[58] Field of Search ..... 81/53.2

[56] References Cited

U.S. PATENT DOCUMENTS 4,476,749 10/1984 McKean ..... 81/53.2

4,513,643 4/1985 McKean ..... 81/53.2

5,277,084 1/1994 Weber et al. ..... 81/53.2

*Primary Examiner*—D. S. Meislin

*Attorney, Agent, or Firm*—Anderson Kill Olick & Oshinsky

[57] ABSTRACT

A setting tool for screwing threaded rods into a base material includes a receiving member (I) with a threaded bore (2) extending axially through it. The receiving member (1) is positioned in a blind bore (4) of an entrainment member (3). Receiving member (1) is axially displaceable relative to the entrainment member (3) by means of a ball thread spindle (6). The axial displacement of the receiving member (1) in the blind bore (4) is limited by a stop (5) and by an annular disk-shaped closure element (8). The threaded rod can extend through the closure element (8) into the threaded bore (2). The engagement of the threaded rods with the stop (5) can be released in a simple manner after the completion of the screwing-in procedure.

6 Claims, 1 Drawing Sheet

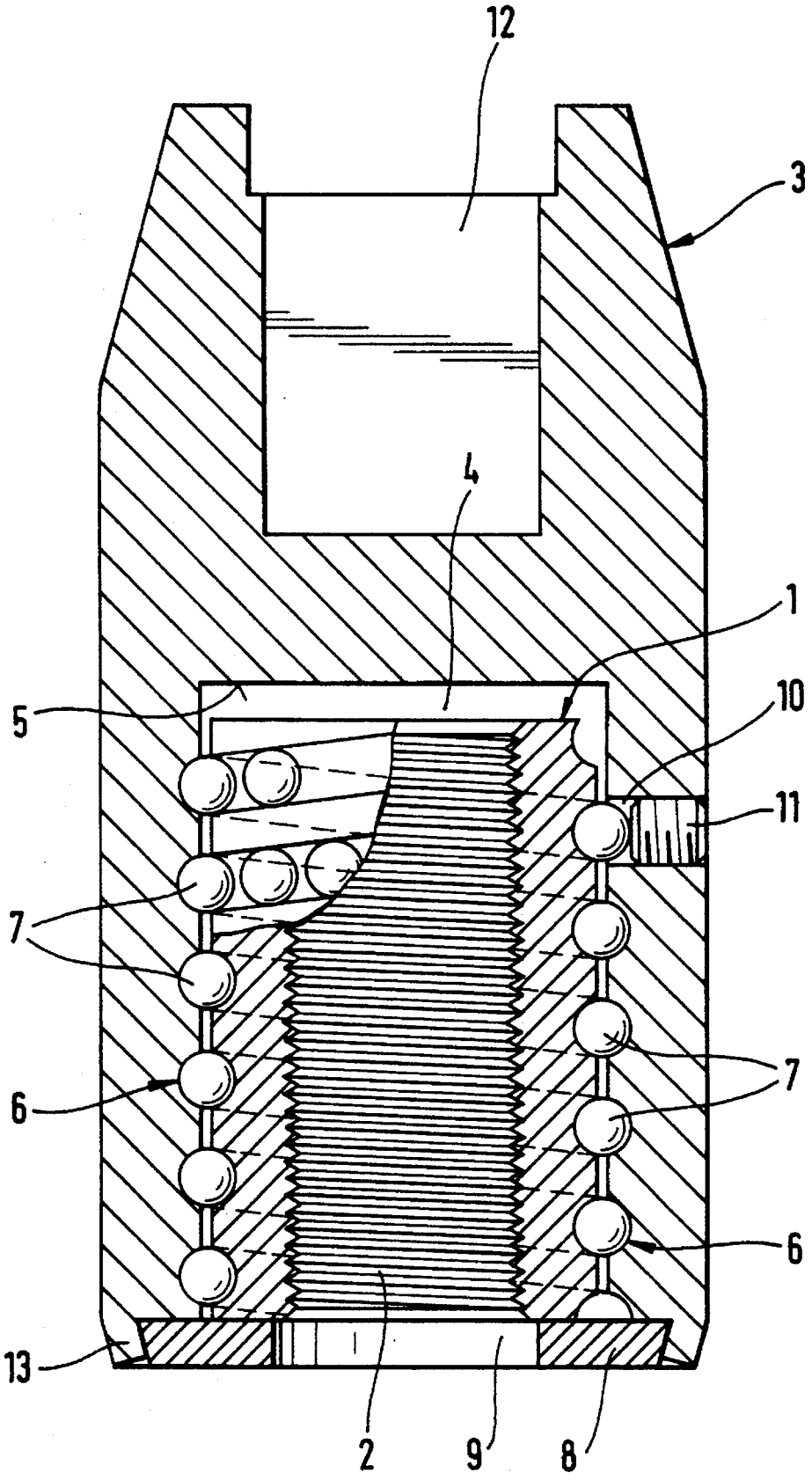
12
3
4
1
5
10
11
7
7
6
6
13
2
9
8

SETTING TOOL FOR THREADED RODS

BACKGROUND OF THE INVENTION

The present invention is directed a setting tool for screwing threaded rods into a base material and comprises a receiving member into which the threaded rods are held in a threaded bore and an entrainment member for transmitting rotary motion to the receiving member. The receiving member is at least partially located in a blind bore in the entrainment member and the entrainment member has a stop limiting the depth of penetration of the threaded rods into the blind bore.

Mechanically driven setting tools are known in which threaded rods are at least partially screwed in and where the rod abuts against a stop before performing of the screwing-in process. The resistance counteracting the screwing-in of the threaded rods results in a bearing contact of the threaded rods against the stop, and the release of the bearing contact is not always effected without problems.

A setting tool is known in DE-GM 8 201 604 where it is possible to release the bearing contact without a detachment of the threaded rods taking place. This known setting tool includes an entrainment member with a blind bore and a clamping shaft enabling the connection of the entrainment member with a manual tool. The base of the blind bore forms a stop for the threaded rods which are threaded into a threaded bore of an additional part of the setting tool, that is, a receiving member. The receiving member is contained in the blind bore with the diameter of the receiving member corresponding essentially to the diameter of the blind bore. The receiving member is held in the axial and circumferential direction in the entrainment member by a radially displaceable locking element with a truncated cone-shaped locking contour. The cone-shaped locking contour projects into an appropriately shaped recess in the outside surface of the receiving member. After the threading-in process is completed, a radial displacement of the locking element into a release position by a suitable tool is effected, so that an axial displacement of the receiving member relative to the entrainment member is possible. In this way the threaded rod is detached from the stop. The removal of the setting rod from the threaded rod occurs without any detachment of the threaded rod.

Considerable disadvantages of the setting tool include the cumbersome manipulation of the tool as well as the additional necessity of using actuation tools for radial displacement of the locking element.

SUMMARY OF THE INVENTION

The primary object of the present invention is to provide an improved setting tool for screwing in threaded rods distinguished by its ease in handling.

In accordance with the present invention, a ball thread spindle having a least one thread turn or revolution is provided between the entrainment member and the receiving member, with the ball thread spindle and the thread in the threaded bore having the same rotational direction.

The setting tool embodying the present invention can be detached from the threaded rod after completing the screwing-in procedure by displacing the setting rod counter to the threading-in direction. The bearing contact between the stop in the setting tool and the threaded rod occurring in the course of the screwing-in process generates forces transmitted from the entrainment member to the receiving member in a point-shaped manner by the balls in the ball thread spindle. As a result, no frictional forces are generated during the detachment process as they would be in the case of surfaces of the two members in contact with one another. The torque required for releasing the bearing contact is smaller by a multiple than the tightening torque needed for the threaded rods. Accordingly, a secure and rapid removal of the setting tool from the fixed threaded rod is possible.

The torque required for releasing the bearing contact between the stop in the entrainment member and the threaded rod can be further reduced by providing the ball thread spindle with several thread turns or revolutions, since the distribution of the forces occurring during the bearing contact procedure is shared by a larger quantity of balls. A ball thread spindle with several thread revolutions has the advantage that a better abutment in centering the receiving member in the blind bore of the entrainment member is obtained. The torque necessary for releasing the bearing contacts can be controlled by the pitch of the ball thread spindle. Preferably, the pitch of the ball thread spindle corresponds to 1.5 to 2 times the diameter of the balls in the ball thread spindle.

The axial displacement of the receiving member within the entrainment member needed for releasing the bearing contact basically can be set very low, since no considerable displacement of the receiving member relative to the entrainment member is necessary.

If the entire inside shape of the entrainment member provides a ball thread spindle, then a cover in the mouth region of the blind bore is necessary, because without such a cover the balls contained in the thread turn of the entrainment member and the receiving member could fall out. Therefore, preferably the entrainment member includes a closure element at its mouth projecting at least partially into the axial projection of the receiving member. This closure element prevents the balls from falling out of the thread turn and limits the axial displacement of the receiving member relative to the entrainment member.

Preferably, for reasons of fabrication as well as for economic considerations, the closure member is shaped as an annular disk with a central through opening for the threaded rods.

The introduction of the balls into the threaded turns of the ball thread spindle is effected prior to the fixation of the closure element to the entrainment member or by utilizing a closeable opening located in the side of the entrainment member.

The quantity of the balls used corresponds basically to the length of the thread turns of the ball thread spindle, divided by the diameter of one ball.

To assure a displacement of the receiving member in the entrainment member, 1 to 3 balls less than the total amount are filled into the thread turns.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

BRIEF DESCRIPTION OF THE DRAWING

The drawing is an elevational view, partly in section, of a setting tool embodying the present invention.

DETAILED DESCRIPTION OF THE INVENTION

In the drawing a setting tool is shown for screwing a threaded rod, not shown, into a base material, not shown. The setting tool is mechanically imparted with a rotational motion and selectively with an impact energy by means of a drive shaft, not shown, engaged in a rotationally locked manner in a coupling region 12 of an axially elongated entrainment member 3. As viewed in the drawing, the entrainment member 3 has the coupling region 12 in its upper end.

The setting tool is comprised of the entrainment member 3, a receiving member 1, a closure element 8, balls 7 and a seal element 11. Entrainment member 3 has a blind bore 4 extending axially from its lower end toward but spaced from the coupling region 12. The receiving member 1 is located in the blind bore 4. The axial length of the receiving member is less than the axial length of the blind bore 4 and the diameter of the receiving member is approximately the same as the diameter of the blind bore 4, however, with the presence of the balls 7 there is no frictional contact between the outside surface of the receiving member and the inside surface of the entrainment member in the blind bore. The base of the blind bore 4 forms a stop 5, which limits the screwing-in depth of the threaded rods.

Receiving member 1 has a centrally arranged axially extending threaded bore 2 and the threads in the bore are matched to the threads of the threaded rods to be screwed in. The outside surface of the receiving member 1 and the outside surface of the blind bore 4 of the entrainment member 3 cooperate form a ball thread spindle 6. The ball thread spindle 6 and the thread of the threaded bore 2 in the receiving member 1 have the same rotational direction. Accordingly, the surface of the blind bore 4 and the outside surface of the receiving member 1 form a number of thread turns or revolutions where a plurality of balls 7 are located.

Entrainment member 3 has a closure element 8 shaped as an annular disk with a central through opening 9 for the threaded rods. The radially outer circumferentially extending edge of the closure element is secured by an inwardly crimped region 13 of the entrainment member 3 laterally encircling the closure member. This fixes the closure element 8 in the axial direction of the entrainment member 3. Closure element 8 prevents the balls 7 from falling out the thread turns in the ball thread spindle 6, and further prevents any penetration of dirt into the thread turns and limits the axial displaceability of the receiving member i with respect to he entrainment member 3. The balls 7 are filled into the thread turns through an opening 10 located in the entrainment member 3 near the stop 5 of the blind bore 4. Accordingly, the balls are inserted into a thread turn of the ball thread spindle in the upper end of the blind bore 4 as viewed in the drawing. The inside cross-section of the opening 10 is at least slightly larger than the diameter of the balls 7. The opening 10 is provided at least partially with a thread, whereby the opening 10 can be closed by a seal element 11.

Initially, a threaded rod is inserted into the threaded bore 2 in the receiving member 1. The threaded members are then screwed into a base material. During this procedure, the receiving member 1 is displaced axially against the stop 5 in the blind bore 4. After the threaded rod has been completely threaded into the base material, such as a foundation subsoil, the setting tool is displaced counter to the screwing-in direction. Accordingly, the bearing contact between the threaded rod and the stop 5 in the blind bore is released. After the receiving member 1 comes into bearing contact with the closure element 8 in the mouth region of the blind bore 4, a relative rotation takes place between the receiving member 1 and the threaded rod. This relative rotation permits the removal of the setting tool from the threaded rod.

While a specific embodiment of the invention has been shown and described in detail to illustrate the inventive principles, it will be understood that the invention may be embodied otherwise without departing from said principles.

I claim:

1. Setting tool for screwing threaded rods into a base material comprising a receiving member (1) with a threaded bore (2) extending axially therethrough and arranged to receive one of the threaded rods, an entrainment member (3) for transmitting a rotary motion to the receiving member (1), said receiving member (1) is located at least partially in a blind bore (4) in said entrainment member (3), and a stop located within said blind bore (4) for limiting the depth of penetration of the threaded rods into the blind bore (4), wherein the improvement comprises a ball thread spindle (6) having least one thread turn provided between said entrainment member (3) and said receiving member (1) where said ball thread spindle (6) and the thread of the threaded bore (2) have the same rotational direction.

2. Setting tool, as set forth in claim 1, wherein said ball thread spindle (6) has a plurality of balls, and said ball thread spindle (6) has a pitch in the range of 1.5 to 2 times the diameter of said balls (7).

3. Setting tool, as set forth in claim 1 or 2, wherein said entrainment member (3) has a closure element (8) extending transversely at least partially in an axial projection of the receiving member (1).

4. Setting tool, as set forth in claim 3, wherein said closure element (8) is an annular disk having a through opening (9) through which the threaded rod can be inserted into the threaded bore (2) in said receiving member (1).

5. Setting tool, as set forth in claim 1, wherein said entrainment member (3) extends axially with a coupling region in one end and said blind bore (4) extending axially inwardly from the other end thereof and in axially spaced relation from said coupling region (12), said receiving member (1) located etirely within said blind bore (4), said receiving member (1) having an axial length less than the axial length of said blind bore (4), and the axially extending outside surface of said receiving member (1) and the axially extending inside surface of said entrainment member (3) having a plurality of thread turns for receiving said balls (7).

6. Setting tool, as set forth in claim 5, wherein an opening extending transversely of the axial direction through said entrainment member (3) into said blind bore (4) adjacent said stop (5) for inserting balls (7) into said thread turns of said ball thread spindle (6), and a seal member insertable into said opening (10) for closing said opening.

* * * * *